US007984676B1

(12) United States Patent
Gavin et al.

(10) Patent No.: US 7,984,676 B1
(45) Date of Patent: Jul. 26, 2011

(54) SYSTEMS AND METHODS FOR A REAR ANCHORED PROJECTILE

(75) Inventors: William D. Gavin, Phoenix, AZ (US); Alaksandar Petrovic, Phoenix, AZ (US); Christopher W. Baldwin, Mesa, AZ (US); Milan Cerovic, Scottsdale, AZ (US)

(73) Assignee: TASER International, Inc., Scottsdale, AZ (US)

( * ) Notice: Subject to any disclaimer, the term of this patent is extended or adjusted under 35 U.S.C. 154(b) by 702 days.

(21) Appl. No.: 11/771,956

(22) Filed: Jun. 29, 2007

(51) Int. Cl.
*F42B 10/00* (2006.01)

(52) U.S. Cl. ..... 102/502; 86/23; 361/232

(58) Field of Classification Search ..... 102/502; 86/23; 361/232
See application file for complete search history.

(56) References Cited

U.S. PATENT DOCUMENTS

| | | | | |
|---|---|---|---|---|
| 3,754,726 | A | | 8/1973 | Rusbach |
| 4,982,645 | A | | 1/1991 | Abboud |
| 5,464,173 | A | | 11/1995 | Sharrow |
| 5,473,501 | A | | 12/1995 | Claypool |
| 5,654,867 | A | | 8/1997 | Murray |
| 5,685,503 | A | | 11/1997 | Trouillot |
| 5,698,815 | A | * | 12/1997 | Ragner ..... 102/502 |
| 5,747,719 | A | | 5/1998 | Bottesch |
| 5,750,918 | A | | 5/1998 | Mangolds |
| 5,786,546 | A | | 7/1998 | Simson |
| 5,831,199 | A | | 11/1998 | McNulty |
| 5,841,622 | A | | 11/1998 | McNulty |
| 5,855,426 | A | | 1/1999 | Burns |
| 5,898,125 | A | | 4/1999 | Mangolds |
| 5,962,806 | A | | 10/1999 | Coakley |
| 5,988,036 | A | | 11/1999 | Mangolds |
| 6,053,088 | A | | 4/2000 | McNulty |
| 6,269,726 | B1 | | 8/2001 | McNulty, Sr. |
| 6,381,894 | B1 | | 5/2002 | Murphy |
| 6,543,364 | B2 | | 4/2003 | Wes |
| 6,553,913 | B1 | | 4/2003 | Wardlaw |
| 6,575,073 | B2 | | 6/2003 | McNulty |
| 6,636,412 | B2 | | 10/2003 | Smith |
| 6,640,722 | B2 | | 11/2003 | Stogermuller |
| 6,877,434 | B1 | | 4/2005 | McNulty |
| 6,880,466 | B2 | | 4/2005 | Carman |
| 7,042,696 | B2 | | 5/2006 | Smith |
| 7,225,741 | B2 | | 6/2007 | Huffman |
| 7,234,399 | B2 | | 6/2007 | Rastegar |
| 2004/0003746 | A1 | | 1/2004 | Niemeyer |
| 2006/0254108 | A1 | | 11/2006 | Park |
| 2006/0279898 | A1 | | 12/2006 | Smith |
| 2007/0101893 | A1 | | 5/2007 | Shalev |
| 2007/0283834 | A1 | | 12/2007 | Chen |

* cited by examiner

*Primary Examiner* — J. Woodrow Eldred
(74) *Attorney, Agent, or Firm* — William R. Bachand; Lawrence Letham

(57) ABSTRACT

A round, according to various aspects of the present invention, comprises an electrified projectile and a case. The projectile delivers a current through a target to incapacitate the target by causing skeletal muscle contractions. The case mechanically couples to a rear portion of the projectile to hold the projectile in the case.

24 Claims, 11 Drawing Sheets

VIEW A-A

SYSTEMS AND METHODS FOR A REAR ANCHORED PROJECTILE

CROSS-REFERENCE TO RELATED APPLICATIONS

US Patent Applications by William Gavin, et al., U.S. patent application Ser. No. 11/771,126 entitled "Systems and Methods for a Projectile Having a Stabilizer for Spin Stabilization", U.S. patent application Ser. No. 11/771,548 entitled "Systems and Methods for Unfastening a Film of an Electrified Projectile", U.S. patent application Ser. No. 11/771,625 entitled "Systems and Methods for Placing Electrodes", and U.S. patent application Ser. No. 11/771,240 entitled "Systems and Methods for Deploying an Electrode Using Torsion", incorporated herein by reference, and the present application are all commonly owned and are all filed Jun. 29, 2007.

FIELD OF THE INVENTION

Embodiments of the present invention relate to systems and methods for anchoring an electrified projectile in a round.

BACKGROUND OF THE INVENTION

Electrified projectiles launched from a smooth bore barrel such as a shot gun have been proposed, but have not become generally available due to unsolved problems including the difficulty in accomplishing suitable accuracy from the format of a shot gun round. Conventional loading of a shot gun round comprises packing materials into the front opening of a shell and closing the opening. This technique leads to unacceptably low accuracies. Conventional solutions for launching electrified projectiles are not practical for low cost, small size, and minor blunt impact. Without the present invention, electrified projectiles will not see wide use for military, law enforcement, and personal defense purposes.

BRIEF DESCRIPTION OF THE DRAWING

Embodiments of the present invention will now be further described with reference to the drawing, wherein like designations denote like elements, and.

DETAILED DESCRIPTION OF THE PREFERRED EMBODIMENTS

Figure 1:
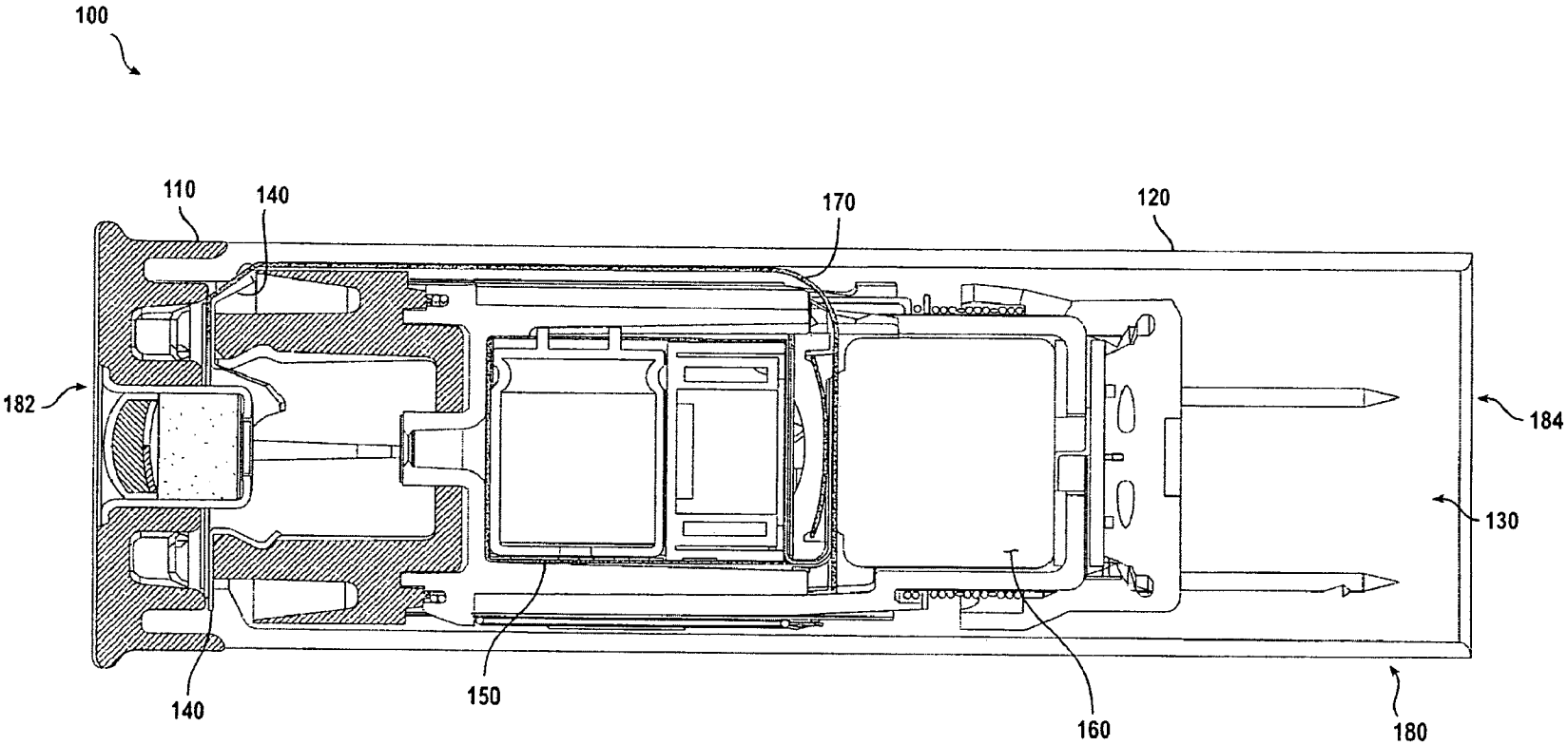
FIG. 1 is a cross-section of a round, according to various aspects of the present invention, including an electrified projectile and an anchor that retains the electrified projectile.

A projectile fired from a smooth bore barrel has a trajectory that may be guided by the barrel until the projectile exits the barrel. After leaving the barrel, momentum may carry the projectile generally along the trajectory of barrel orientation. However, the projectile may leave the desired trajectory. Leaving the desired trajectory results in inaccurate delivery. Conventional projectiles have a front portion. In many applications, it may be important for the front portion to hit the target before any other portion of the projectile hits the target. This sequence may be accomplished by maintaining the orientation of the projectile throughout flight.

It may be desirable that the impact of the projectile with the target not cause serious injury to the target due to blunt force. Consequently, light weight electrified projectiles with relatively low muzzle velocity are desirable.

At light weight and low muzzle velocity, the conventional closure at the front of a round may interfere with accuracy. According to various aspects of the present invention, as electrified projectile may be held in a round without the conventional front closure.

A round that includes an electrified projectile, according to various aspects of the present invention, maintains the projectile in a stowed condition until after launch. The round may include a propulsion system (e.g., pyrotechnic shell) and/or cooperate with a propulsion system (e.g., compressed air). Launching propels the projectile away from the round (e.g., out of a shell) and through a smooth bore barrel for impact with a human or animal target.

An electrified projectile includes any apparatus that establishes a circuit through the target for delivery of a stimulus signal for immobilizing the target. An electrified projectile may include an energy source (e.g., battery, charged capacitor), a circuit (e.g., signal generator and controls), and one or more electrodes. The signal generator may provide an electrical stimulus signal (e.g., current) in a circuit through the electrodes and through the target sufficient to cause contraction of skeletal muscles to immobilize the target. One or more electrodes for establishing a suitable circuit for the current may be fixed to portions of the projectile or launched from the projectile (e.g., wire-tethered to a portion of the projectile). Portions of the projectile may separate from each other in flight or after impact with a target to accomplish suitable spacing between electrodes.

A round retains an electrified projectile prior to launch. A round having an open front end may avoid damage to electrodes positioned on a front of the electrified projectile during launch. An open front end may reduce an amount of energy required to launch the electrified projectile. Retaining the electrified projectile in a round that does not have a front closure may increase safety, provide more uniform launch performance, provide convenience of use, and/or simplify handling. Retaining a rear portion of the electrified projectile may increase accuracy of delivery. Retaining the electrified projectile in the round may be accomplished so that the signal generator couples to the energy source upon launch and permits testing during assembly and while in the round.

An electrified projectile, according to various aspects of the present invention may disconnect the signal generator from the energy source prior to launch to conserve energy and lengthen the life of the energy source. The projectile may facilitate connecting the energy source to the signal generator prior to launch to permit circuit testing during and after assembly.

A round according to various aspects of the present invention performs the functions and overcomes the problems discussed above. A round may include any apparatus for launching an electrified projectile. Any conventional method of propelling a projectile may be used. An electrified projectile may include a propulsion system and/or propellant. A launching apparatus and/or a round may facilitate the simultaneous launching of any number of electrified projectiles. A round may include a case and a base having a form factor and made of materials suitable for use in a conventional weapon for breach loading or muzzle loading (e.g., cannon, mortar, 40 mm grenade launcher, flare gun, musket, 12-gauge shotgun, 20-gauge shotgun, pistol). The weapon may initiate launch of the projectile by any conventional apparatus (e.g., percussion firing thread, switched electrical current).

Figure 2:
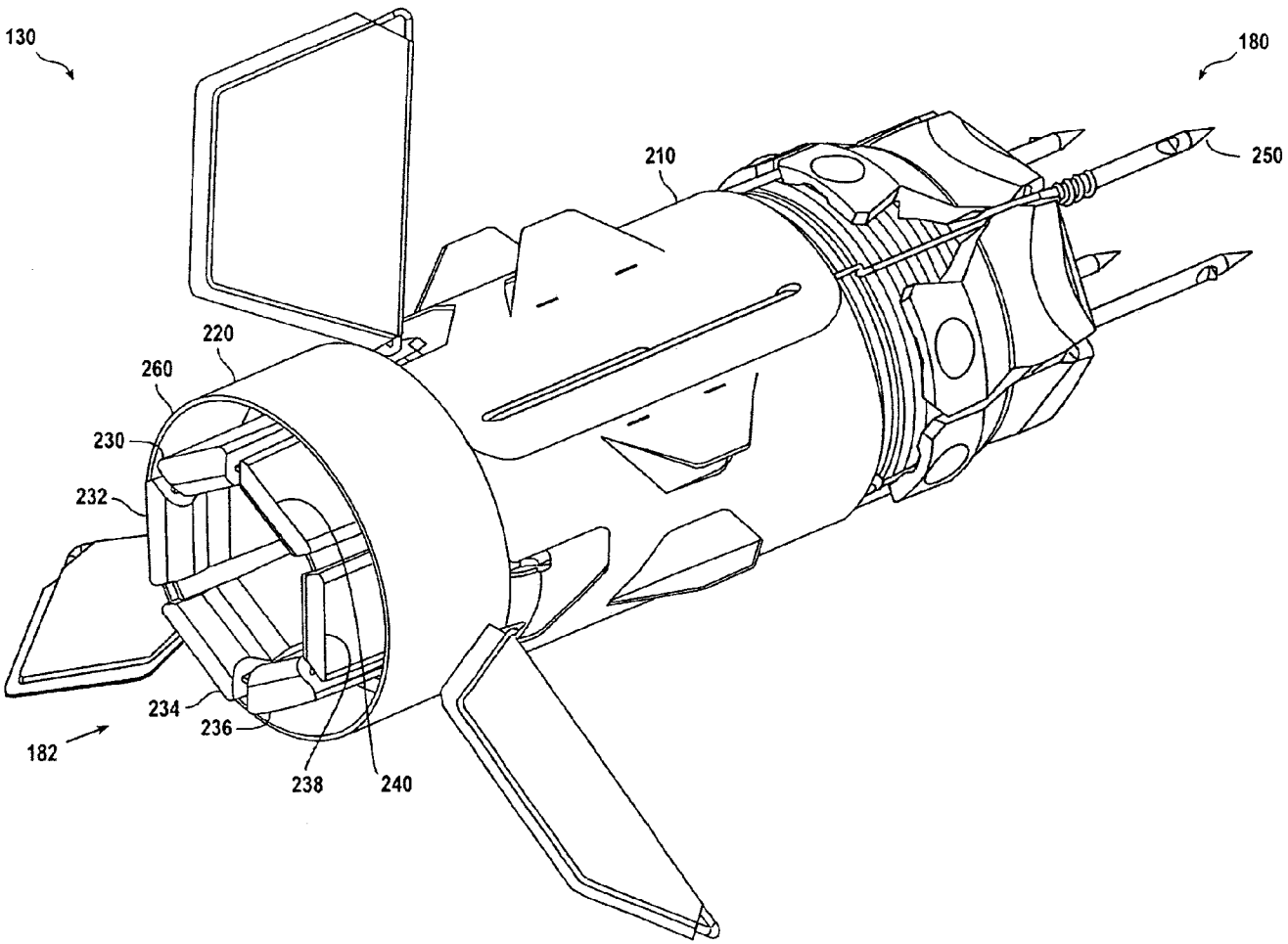
FIG. 2 is a perspective plan view of the electrified projectile of FIG. 1 in flight.
Figure 3:
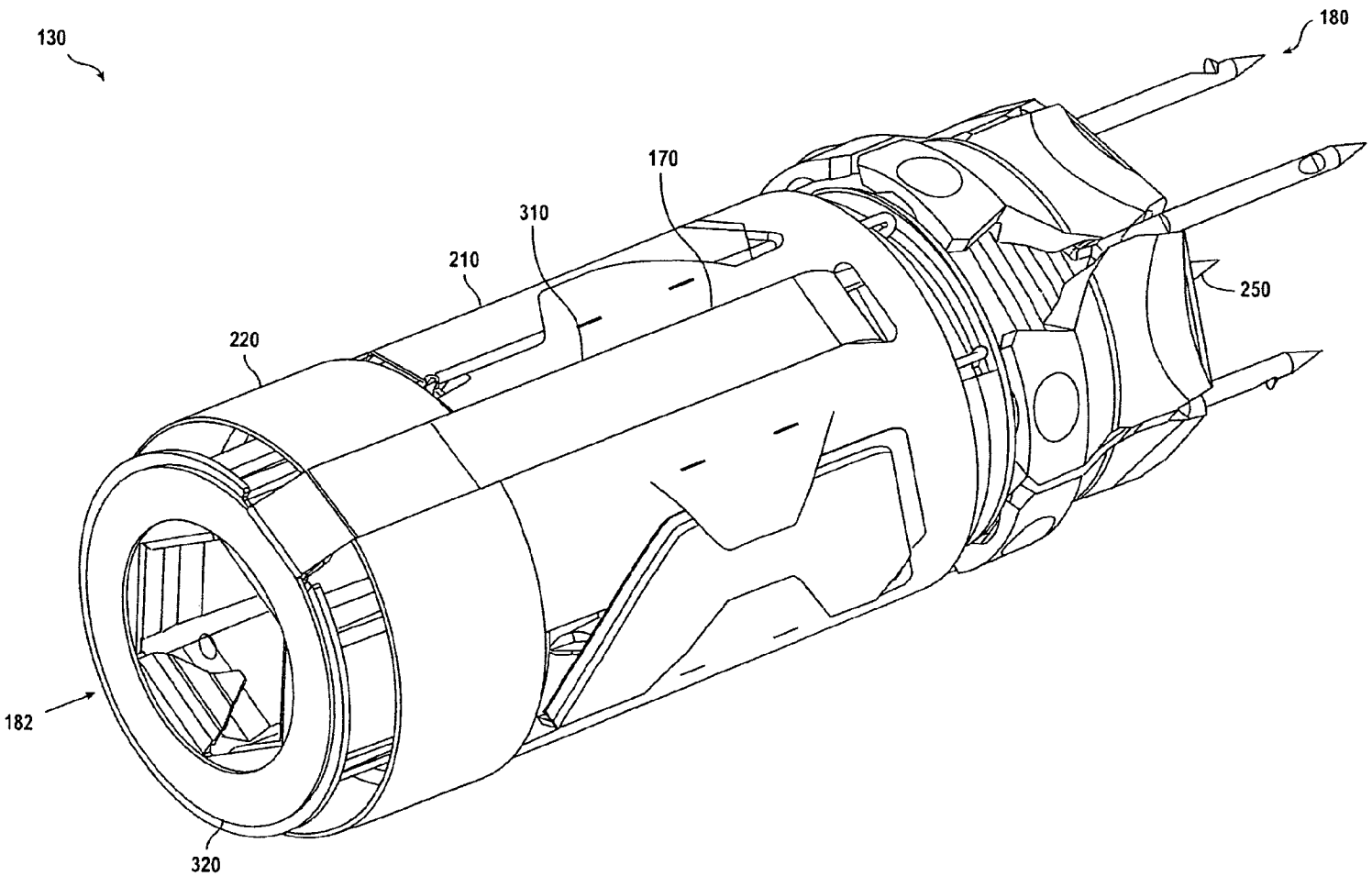
FIG. 3 is a perspective plan view of the electrified projectile of FIG. 1 prior to loading the projectile into a shell.
Figure 4:
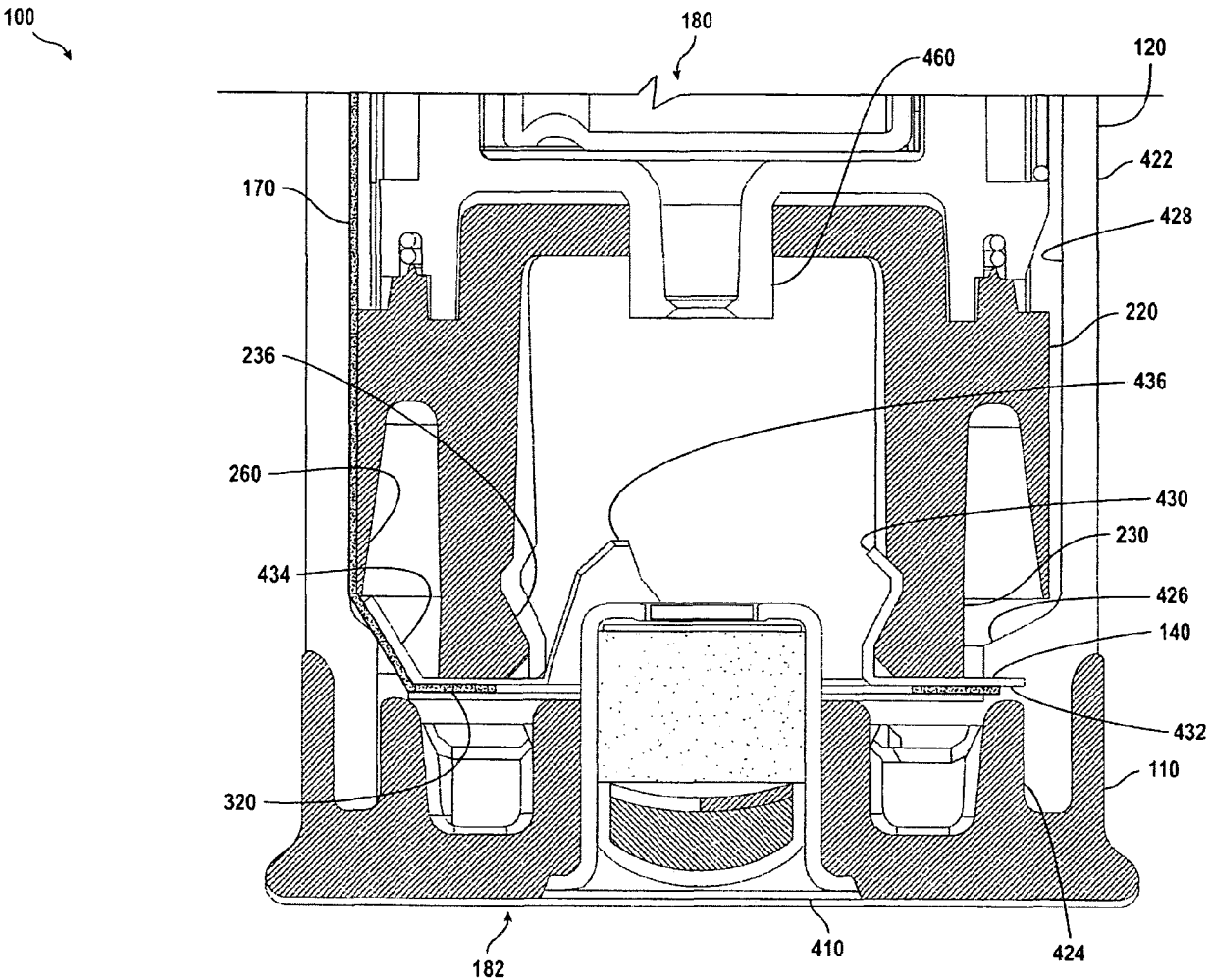
FIG. 4 is an expanded, cross-sectional view of a rear portion of the round of FIG. 1.
Figure 5:
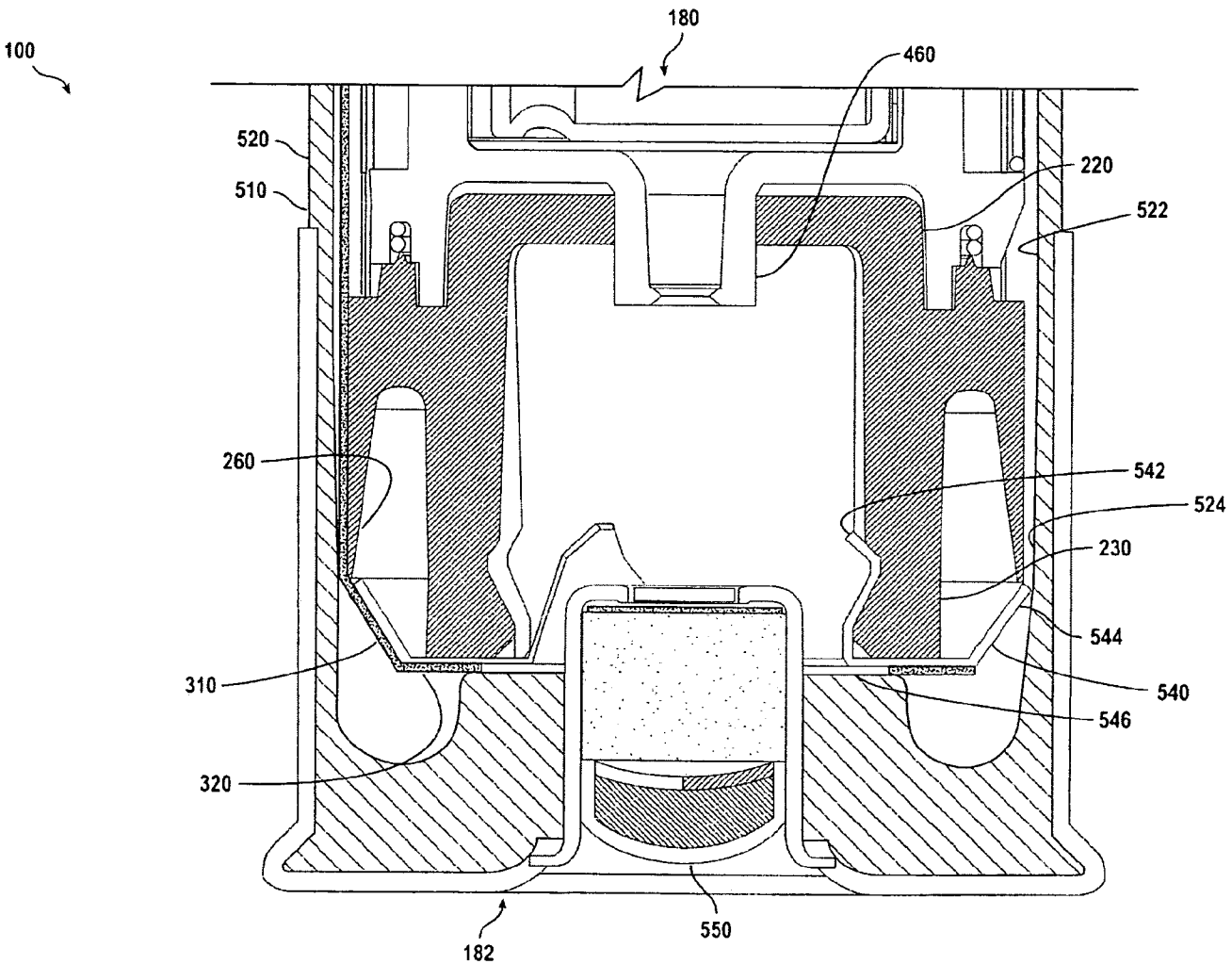
FIG. 5 is an expanded, cross-sectional view of a rear portion of another round according to various aspects of the present invention.
Figure 6:
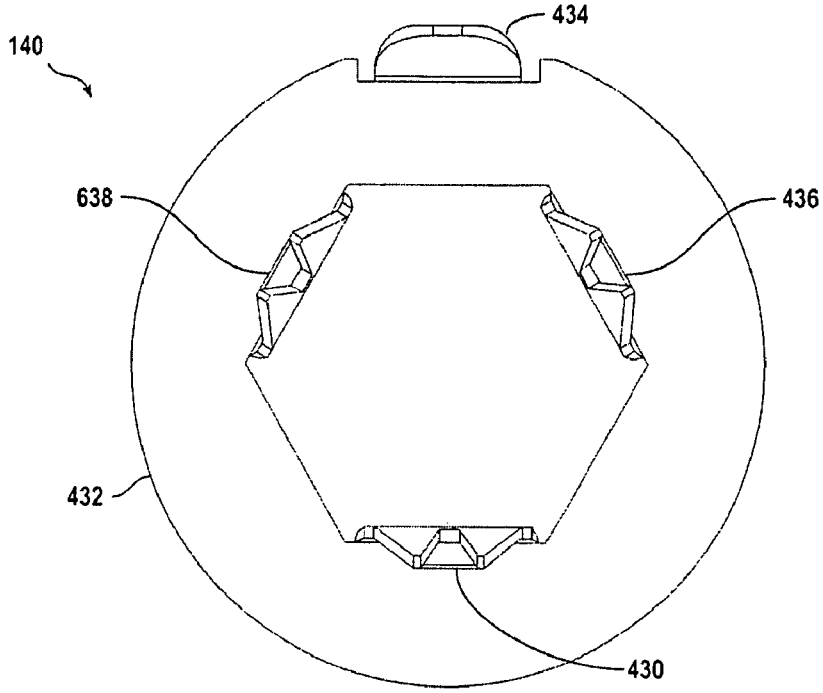
FIG. 6 is a top view of the anchor of FIGS. 1 and 4, according to various aspects of the present invention.
Figure 7:
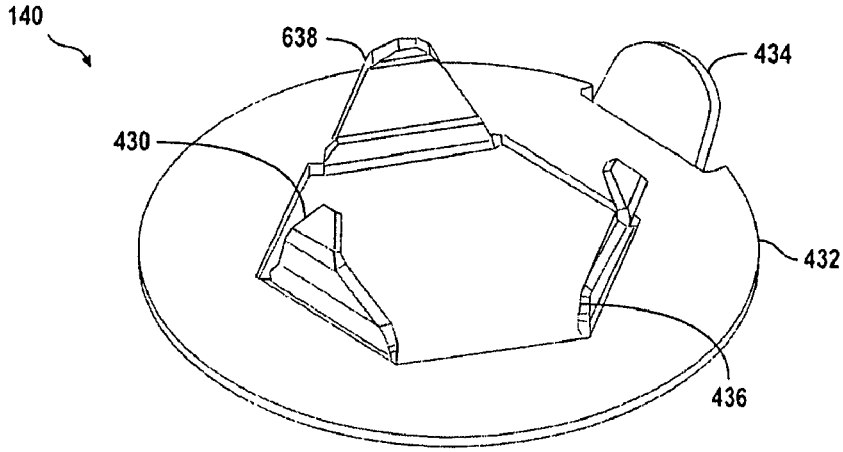
FIG. 7 is a perspective plan view of the anchor of FIGS. 1 and 4.
Figure 8:
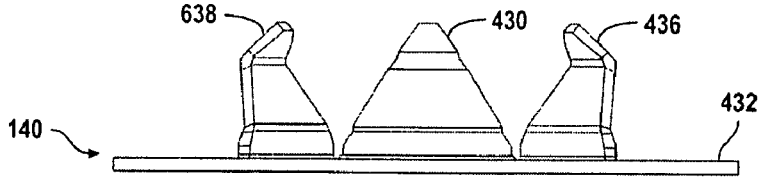
FIG. 8 is a side view of the anchor of FIGS. 1 and 4.
Figure 9:
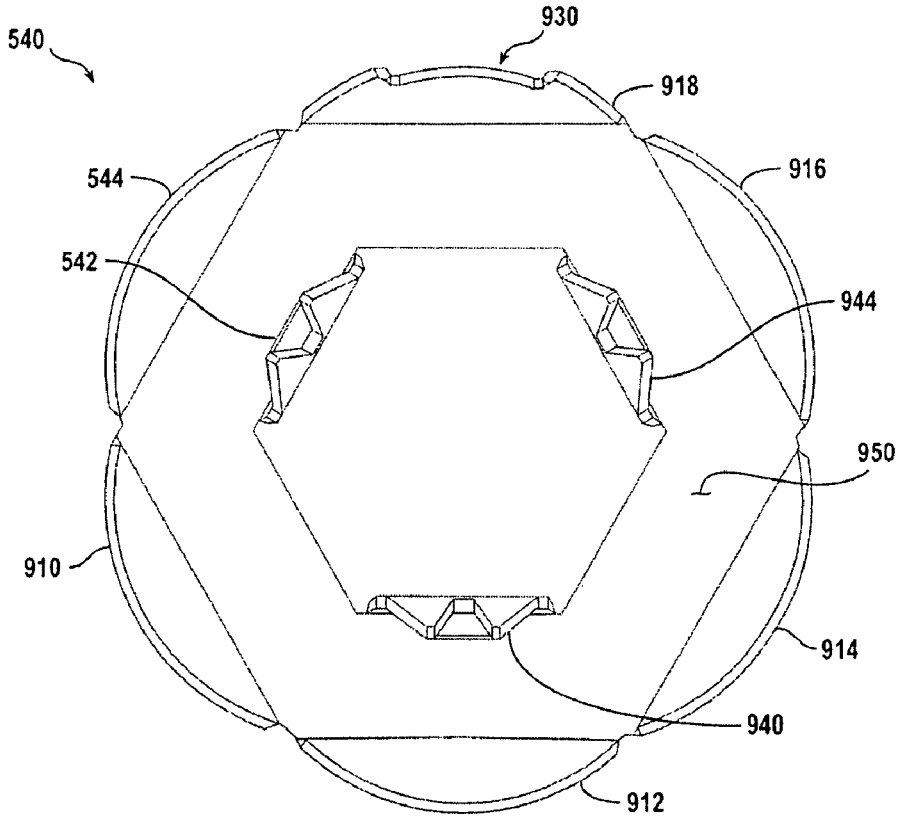
FIG. 9 is a top view of the anchor of FIG. 5, according to various aspects of the present invention.
Figure 10:
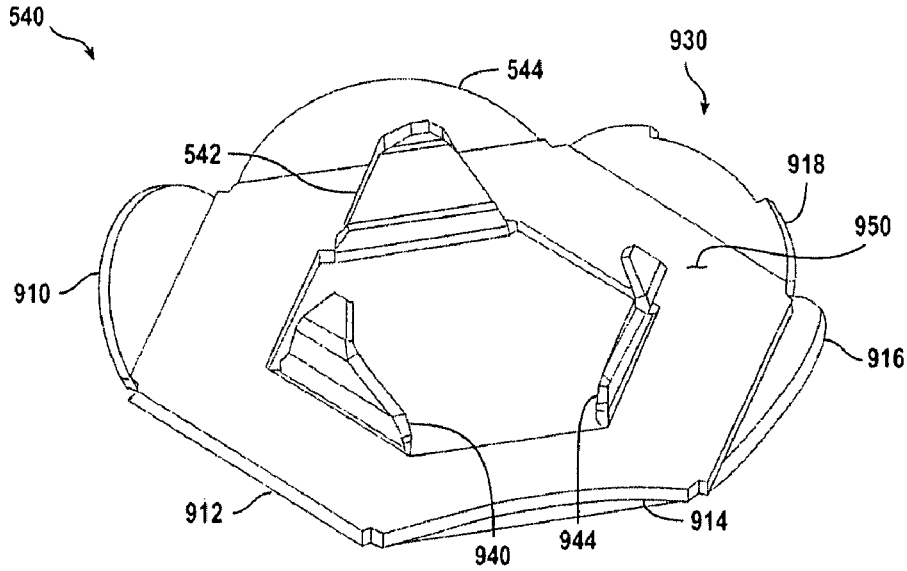
FIG. 10 is a perspective plan view of the anchor of FIG. 5.
Figure 11:
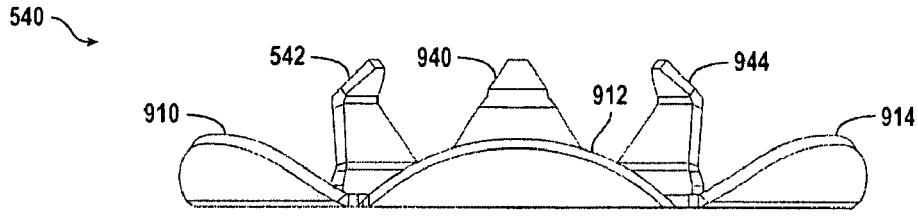
FIG. 11 is a side view of the anchor of FIG. 5.
Figure 12:
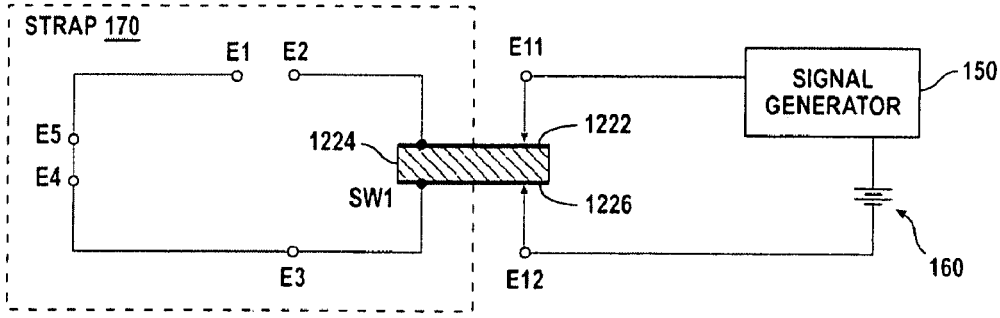
FIG. 12 is a circuit diagram of the strap of FIG. 1, according to various aspects of the present invention.
Figure 13:
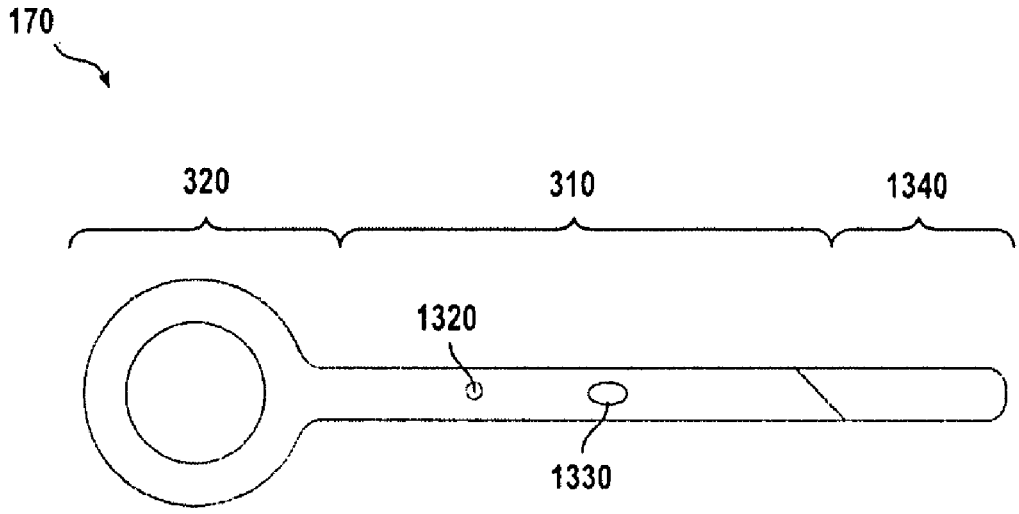
FIG. 13 is a front view of an implementation of the strap of FIGS. 1 and 12.
Figure 15:
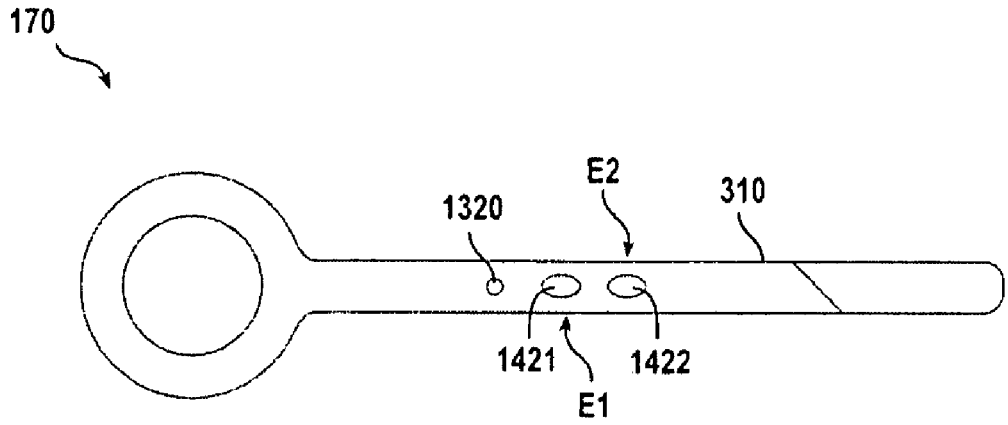
FIG. 15 is a back view of the strap of FIG. 13.
Figure 14:
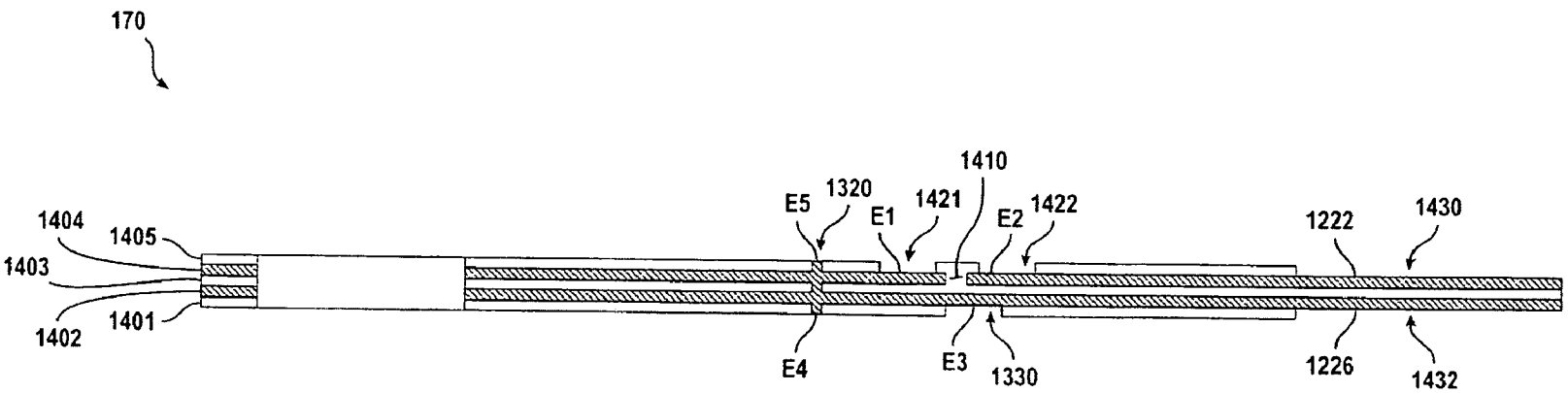
FIG. 14 is a cross-sectional side view of the strap of FIG. 13.
Figure 16:
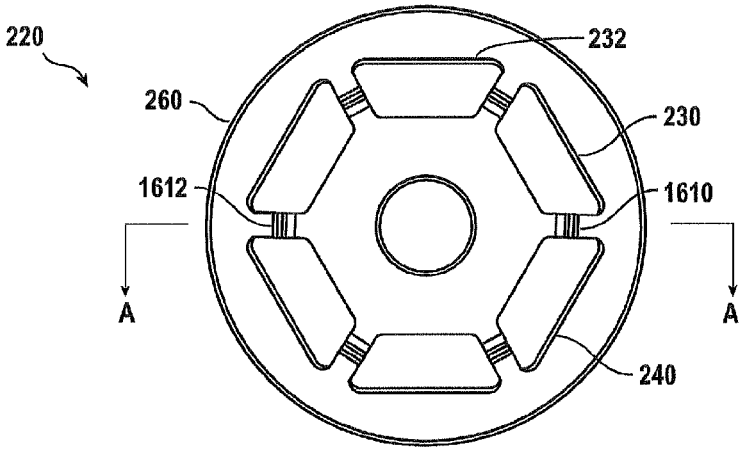
FIG. 16 is a rear view of the wad of FIG. 2, according to various aspects of the present invention.
Figure 17:
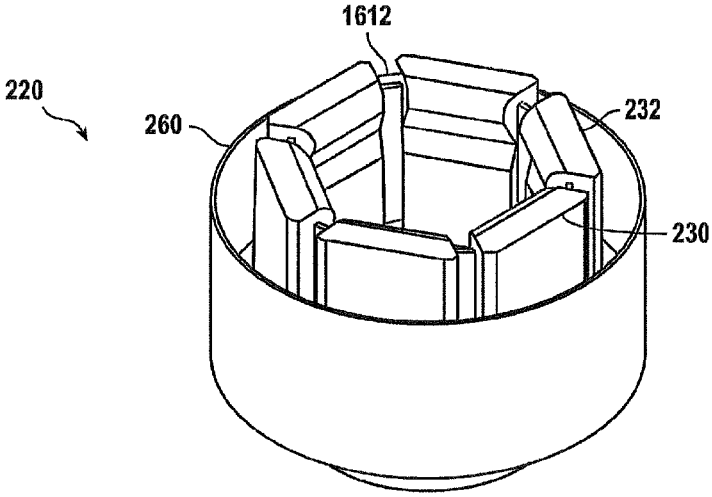
FIG. 17 is a perspective plan view of the wad of FIG. 2.
Figure 18:
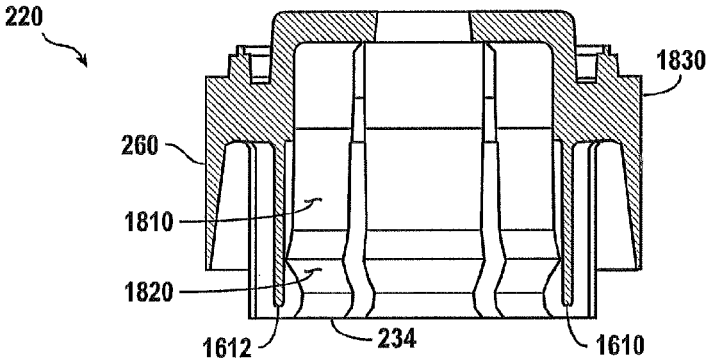
FIG. 18 is a cross-sectional view of the wad of FIG. 16 at A-A.

For example, round 100 of FIGS. 1-18, includes base 110, case 120, electrified projectile 130, and anchor 140.

An electrified projectile includes any apparatus that travels toward a target, places electrodes on a target, and delivers a stimulus signal. An electrified projectile may deliver a stimulus signal by transporting to the target a source of energy and a signal generator.

An electrified projectile includes any apparatus that establishes a circuit through the target for delivery of a stimulus signal for immobilizing the target. A signal generator may provide an electrical stimulus signal (e.g., current) in a circuit through the electrodes and through the target sufficient to cause contraction of skeletal muscles to immobilize the target. One or more electrodes for establishing a suitable circuit for the current may be fixed to portions of the projectile or launched from the projectile (e.g., wire-tethered to a portion of the projectile). Portions of the projectile may separate from each other in flight or after impact with a target to accomplish suitable spacing between electrodes. For example, projectile 130 delivers a stimulus signal by exiting round 100, exiting a weapon, flying toward a target, contacting a target, and delivering a stimulus signal.

A base may provide a shape suitable for use in a breech of a conventional weapon. A base may provide a force for launch. A base receives a signal from the weapon to launch the projectile. A base includes any apparatus for positioning a round in a breech for launching a projectile. For example, base 110 has a shape suitable for placing in the breech of a conventional weapon such as a 12-gauge shot gun. Base 110 may be positioned toward rear 182 of round 100.

A case may provide a channel for launching the projectile. A case may direct a force of launch to launch the projectile. A case may have a shape suitable for use in a barrel of a conventional weapon. A case may house and protect the electrified projectile prior to launch. For example, case 120 may be substantially cylindrical. Case 120 has a diameter suitable for placing in a barrel (e.g., via the breach) of a conventional weapon such as a 12-gauge shot gun. Case 120 may be positioned toward front 180 of round 100. Front opening 184 of case 120 is not closed. Case 120 directs a force of launch from base 110 toward the forward portion of round 100.

An anchor includes any structure that may provide a retaining force. The retaining force may be releasable. An anchor retains an electrified projectile in a round prior to launch. An anchor may release an electrified projectile for launch from the round. For example, anchor 140 retains electrified projectile 130 in round 100. A force for launch from base 110 releases the retaining force of anchor 140 such that electrified projectile 130 exits case 120.

A projectile may include, among other things, a body, a wad, and a strap. A body houses components (e.g., energy source, signal generator) of a projectile and may provide a ballistic profile. A wad generally harnesses a force of propulsion to launch the projectile. A wad may cooperate with an anchor to retain a projectile in a round prior to launch. A wad may be positioned toward a rear of the projectile. A wad may include any structure that cooperates with an anchor to selectively retain and release a projectile. A wad may include any structure that releasably retains a projectile in a round. A strap selectably connects and/or disconnects an energy source to a circuit. A strap selectably connects through physical movement of the strap with respect to the projectile and/or establishing an electrical coupling with the strap. The strap may selectably connect during assembly, after assembly but prior to launch, and at launch. A strap includes any structure that selectably connects and disconnects an energy source.

For example, projectile 130 includes body 210, wad 220, and strap 170. Wad 220 may be positioned toward rear 182 of electrified projectile 130. Wad 220 includes grips 230-240 that cooperate with an anchor. Wad 220 includes gas check 260 to harness a force of propulsion. Strap 170 selectively connects battery 160 and signal generator 150.

A base may include a primer. A primer may provide a force of propulsion for launch. A force of propulsion propels the electrified projectile from the round. A primer includes any apparatus that may provide a force of propulsion. For example, base 110 includes primer 410. In one implantation, primer 410 includes gun powder. Striking primer 410 with a pin causes the gun powder to burn. The expanding gas from the burning powder may provide the force of propulsion to launch the projectile.

A case may include a wall, an inner surface, a bonding surface, and a shoulder. A wall establishes the shape of the case. A wall accepts the projectile. A wall protects the projectile during storage and prior to launch. A wall enters and exits a barrel of a conventional weapon. A wall directs a force of propulsion for launch in a forward direction. A case includes any structure that defines the shape of a case. An inner surface establishes an inside geometry of the case. An inner surface forms a seal with a wad to direct a force of propulsion in the direction of a front of the case. An inner surface may be proximate to the electrified projectile. An inner surface includes any structure and/or material that defines an inside geometry of a case. A bonding surface may provide a surface for coupling the base to the case. A bonding surface includes any structure that permits bonding. A shoulder may provide a surface for retaining. A shoulder may provide a surface for applying a force to retain. A shoulder includes any structure that retains or receives a force to retain.

For example, case 120 includes wall 422, inner surface 428, bonding surface 424, and shoulder 426. Wall 422 may be substantially cylindrical. Wall 422 may be formed of a plastic that withstands the force of propulsion. Inner surface 428 may be the inner surface of wall 422. Inner surface 428 seals with wad 220 to direct the force of propulsion. Inner surface 428 may be proximate to projectile 130. Bonding surface 424 mates with a surface of base 110. Bonding surface 424 may receive a solvent and/or adhesive to connect base 110 to case 120. Anchor 140 abuts shoulder 426. Anchor 140 applies a force on shoulder 426. Shoulder 426 may provide a surface for the retaining force of anchor 140.

In another implementation, a case includes a wall, an inner surface, and an inclined surface. For example, case 510 includes wall 520, inner surface 522, and inclined surface 524. Inner surface 522 may be the inner surface of wall 520. Inner surface 522 seals with wad 220 to direct a force of propulsion. Inner surface 522 may be proximate to projectile 130.

An inclined surface may provide a surface for retaining. An inclined surface includes any structure that may provide a retaining force. For example, inclined surface 524 interferes with anchor 540 such that anchor 540 does not move in a forward direction toward front opening 184.

A gas check may provide a seal to contain and harness a force of propulsion to propel the projectile from the case. A gas check seals with an inner surface of a case. The seal prevents the force of propulsion (e.g., expanding gas) from bypassing the projectile. A gas check increases the percentage of total force that propels rather than escaping the case without propelling. A gas check reduces the total amount of energy required to propel a projectile. A gas check includes any structure that seals with an inner surface to harness a force of propulsion.

For example, the force of the expanding gas provided by primer 410 moves gas check 260 outward so that gas check 260 sealably contacts inner surface 428. Having established a seal, the force of propulsion pushes against wad 220 to propel projectile 130 from case 120 and the weapon. Absent a seal, at least a portion of the expanding gas flows past electrified projectile 130 without imparting any forward thrust.

In another implementation, gas check 260 seals against inner surface 522 and in a similar manner harnesses the force of propulsion.

A grip may provide a surface for restraining a projectile in a round. A plurality of grips are located on a rear portion of the projectile to retain the projectile from the rear. A grip flexes to permit releasable retention. A grip includes any structure that provides a surface for reliable retention. For example, grips 230-240 are located on a rear portion of projectile 130. Grips 230-240 flex outward toward inner surface 428 and 522 under the force of the expanding gas from primer 410 and 550 respectively.

A wad may be formed of any material that flexes under force and forms a suitable seal. For example, wad 220 may be formed of low density polyethylene (e.g., LDPE). Wad 220 may couple to body 210. The coupling between body 210 and wad 220 may be releasable or release resistant. Separation of the wad from the body may reduce a force of impact of a projectile with a target. Retaining the wad connected to the body at least until impact may improve the flight characteristics of the projectile. In one implementation, wad 220 may be releasable coupled to body 210 such that wad 220 separates from body 210 upon exit of projectile 130 from a barrel.

In another implementation, wad 220 remains connected to body 210 until and possibly through impact. Wad 220 may be coupled to body 210 in any manner to suitably retain the coupling. For example, a push nut (not shown) couples to stem 460 to retain wad 220 to body 210 up until and possibly through impact. A coupling that exerts less coupling force may permit undesirable separation between body 210 and wad 220 after launch and before impact. Separation or detachment before impact may alter aerodynamic surfaces of projectile 130 and/or disrupt flight.

An anchor may include a retainer, a prong, and a tab. For example, anchor 140 includes retainer 432; prongs 430, 436, and 638; and tab 434. A retainer restrains the forward movement of the anchor. A retainer may provide a structural base to hold prongs. A retainer includes any structure for restraining forward movement. A retainer includes any structure for supporting prongs. For example, retainer 432 abuts shoulder 426 of case 120 to restrain forward movement of anchor 140. Shoulder 426 stops the movement of anchor 140 toward front 180.

A prong may provide a retaining force. The retaining force provided by a prong releaseably retains a projectile. A prong includes any structure for providing a retaining force on a projectile. For example, prong 430 contacts grip 230. Prong 430 interferes with movement of grip 230 in a forward direction. When the force of propulsion forces grip 230 to flex outward, prong 430 no longer interferes with grip 230 and the retaining force on projectile 130 may be released.

A grip may include an arm having a notch. The notch cooperates with a prong of an anchor to retain and to release the projectile. For example, grip 234 comprises arm 1810 having notch 1820. Wad base 1830 supports each grip 230, 232, 234, 236, 248, and 240 and gas check 260.

A tab may provide a channel between a forward portion of the round and a rear portion of the round. The channel forms between the tab and an inner surface of the case. The channel may provide a conduit for a mechanical communication between the rear and the front portion. In an implementation where the mechanical communication may be a coupling, the shape of the tab may reduce strain. A tab may be any structure that forms a channel. A tab may form a channel of any length, height, or width.

For example, tab 434 angles away from inner surface 428 leaving a channel. Strap 170 may be disposed in the channel such that a portion of strap 170 may be disposed in the front portion of round 100 and another portion of strap 170 may be disposed in the rear portion of round 100. The angle of inclination of tab 434 away from inner wall 428 establishes the height of the channel. The width and length of tab 434 establishes the width and length of the channel respectively.

Strap 170 may be positioned in a channel. The angle of tab 434 with respect to retainer 432 releases strain placed on strap 170.

In another implementation, an anchor includes a retainer, a prong, a rim, and a gap. For example, anchor 540 includes anchor base 950; prongs 542, 940, and 944; rims 544 and 910-918; and gap 930.

An anchor base may provide structural support to prongs and rims. A base retains a positional relationship between rims and prongs. An anchor base may be any structure that may provide structural support. For example, anchor base 950 couples to prongs 542, 940, and 944; and rims 544 and 910-918.

As described above, prongs 542, 940, and 944 provide a retaining force. For example, prong 542 contacts grip 230. Prong 542 interferes with movement of grip 230 in a forward direction. When the force of propulsion forces grip 230 to flex outward, prong 542 no longer interferes with grip 230 and the retaining force on projectile 130 may be released.

A rim restrains the forward movement of the anchor. A rim interferes with the inner surface of a case to prevent forward movement. A rim includes any structure that restrains movement by interference. For example, rim 544 interferes with inclined surface 524 of case 510 to prevent movement of anchor 540 toward front 180.

A gap may provide a channel between a forward portion of the round and a rear portion of the round in a manner similar to a tab as discussed above. The dimensions of the gap determine the dimensions of the channel. A gap includes any structure that forms a channel. For example, gap 930 does not contact inner surface 522 thereby forming a channel. In one implementation, strap 170 may be positioned in the channel.

Assembly of a round may include, according to various aspects of the present invention, inserting an electrified projectile in a front opening of a case, inserting an anchor into a rear of the case, positioning a strap proximate to the anchor, aligning the strap and anchor, attaching a base to the case, and/or inserting a primer into the base.

For example, assembly of round 100 includes, in any practical order, inserting projectile 130 into front opening 184 of case 120. Wad 220 of projectile 130 enters front opening 184 first so that frontal electrode 250 may be oriented toward front 180 after insertion. Strap 170 extends from a front portion of projectile 130 past the rear of projectile 130. Projectile 130 may be rotated to position strap 170 in a location where case 120 does not have shoulder 426. Projectile 130 may be inserted into case 120 until wad 220 contacts shoulder 426.

Anchor 140 may be inserted into rear 182 of case 120. Anchor 140 may be rotated to align tab 424 with the portion of case 120 that does not have shoulder 426 and where strap 170 may be positioned. Anchor 140 may be moved in a forward direction and projectile 130 in a rearward direction until prongs 430, 436, and 638 contact with three of grips 230-240. Applying forward pressure to anchor 140 and rearward pressure to projectile 130 mates the prongs to the grips such that the prongs interfere with and hold the grips. Retainer 432 abuts shoulder 426, thus projectile 130 may be retained in the case 120 at the rear portion of projectile 130.

The rear portion of strap 170 may be folded over to lie proximate to anchor 140 preparatory to inserting base 110.

Base 110 couples to a rear portion of case 120. Bonding surface 424 mates with a similar surfaced on base 110. Base 110 may be attached to case 120 in any manner. For example, base 110 may be attached to case 120 using a solvent and/or adhesive.

Primer 410 may be inserted into an opening in base 110.

In another implementation, assembly of a round may include positioning a strap proximate to an electrified projectile, coupling an anchor to an electrified projectile, positioning a strap proximate to the anchor, inserting an electrified projectile in a front opening of a case, and/or inserting a primer into a base.

For example, assembly of round 100 includes, in any practical order, positioning strap 170 proximate to a side of electrified projectile 130. A portion of strap 170 may be positioned near a front portion of electrified projectile 130. When strap 170 may be placed proximate to a side of electrified projectile 130, a portion of strap 170 extends past a rear of electrified projectile 130.

Rotating anchor 540 until gap 930 aligns with the portion of strap 170 that extends past the rear of electrified projectile 130.

Coupling prongs 542, 940, and 944 of anchor 540 to three of grips 230-240 of wad 220. Coupling may be accomplished in any manner. For example, anchor 540 may be inserted into wad 220 such that prongs 542, 940, and 944 contact three of grips 230-240. The prongs mate with the grips such that the prongs interfere with and hold the grips, thereby coupling anchor 540 to electrified projectile 130.

The rear portion of strap 170 may be positioned over to lie proximate to anchor 540 preparatory to inserting electrified projectile 130 into case 510.

Inserting electrified projectile 130 into front opening 184 of case 510. Anchor 540 enters front opening 184 first so that frontal electrode 250 may be oriented toward front 180 after insertion. As projectile 130 moves in a rearward direction, rims 544 and 910-918 move past inner surface 522 without interference. Projectile 130 may be inserted into case 510 until rims 544 and 910-918 contact and interfere with inclined surface 524. Projectile 130 may be pressed in a rearward direction until the force of interference of rims 544 and 910-918 with inclined surface 524 may be sufficient to hold electrified projectile 130 in case 510, thus projectile 130 may be retained in the case 510 at the rear portion of projectile 130.

Primer 550 may be inserted into an opening in the rear of case 510.

An energy source may provide energy for the stimulus signal. An energy source includes any type of apparatus that stores and/or may provide energy. For example, battery 160 may provide electrical energy for a stimulus signal. Battery 160 electrically couples with signal generator 150 to provide energy. In another implementation, a charged capacitance may provide electrical energy for a stimulus signal.

A signal generator forms energy into a stimulus signal. A stimulus signal may be delivered as a series of current pulses. A signal generator may be any apparatus that forms a stimulus signal. For example, signal generator 150 receives electrical energy from battery 160 and may provide a stimulus signal that includes one or more pulses of current.

Inserting electrified projectile 130 into front opening 184 of case 510. Anchor 540 enters front opening 184 first so that frontal electrode 250 is oriented towards front 180 after insertion. As projectile 130 moves in a rearward direction, rims 544 and 910-918 move past inner surface 522 without interference. Projectile 130 is inserted into case 510 until rims 544 and 910-918 contact and interfere with inclined surface 524. Projectile 130 is pressed in a rearward direction (toward stop 546) until the force of interference of rims 544 and 910-918 with inclined surface 524 is sufficient to hold electrified projectile 130 in case 510, thus projectile 130 is retained in the case 510 at the rear portion of projectile 130.

A strap may provide a switch between an energy source and a signal generator. A strap may be any apparatus and/or structure that couples or decouples a source of energy. A strap may provide terminals for establishing a connection between the energy source and the signal generator. A strap may establish a connection by physical movement of the electrical projectile with respect to the strap.

For example, strap 170 may provide terminals E1, E2, and E3. Connecting E2 to E3 and/or E1 to E2 couples battery 160 to signal generator 150. Strap 170 also includes pull switch SW1. SW1 includes layers 1222, 1224, and 1226. Layer 1224 may be an insulator. Layers 1222 and 1226 are conductors. Terminal E11 of signal generator 150 and terminal E12 of battery 160 are biased to contact each other. While SW1 may be positioned between E11 and E12, layer 1224 stops all current flow between E11 and E12. While SW1 may be physically positioned between E11 and E12 connection between signal generator 150 and battery 160 must be established using terminals E1, E2, and E3. Pulling strap 170 such that pull switch SW1 may be physically removed from between E11 and E12 permits E11 and E12 to contact each other.

Switch SW1 may be pulled away from E11 and E12 in any manner and at any time. For example, launching electrified projectile 130 pulls SW1.

A strap includes a ring and a strip. A channel interferes with a ring to retain the strap in the case. A ring includes any structure that retains the strap in the case through interference with the channel. A strip couples the ring to an end portion. A strip traverses a channel from a front portion to a rear portion of a case. A strip physically separates a power source and a signal generator until launch. A strip enables selective coupling of the power source and the signal generator. A strip includes any structure that selectively couples and physically separates before launch.

For example, strap 170 includes ring 320 and strip 310. Strip 310 includes front portion 1340. Ring 320 may be located at a rear portion of strap 170. Strip 310 extends from ring 320. Front portion 1340 of strip 310 may be positioned between signal generator 150 and battery 160 prior to launch. Front portion 1340 physically separates battery 160 from signal generator 150.

Ring 320 may be positioned proximate to anchor 140 prior to attaching base 110. Ring 320 may be positioned proximate to anchor 540 prior to inserting electrified projectile 130 into case 510. A portion of strip 310 may be positioned in the channel formed by tab 434 and/or gap 930.

Ring 320 may be larger than the channel formed by tab 434 and/or gap 930. During launch, tab 434 and/or gap 930 interferes with ring 320 such that as projectile 130 exits case 120 front portion 1340 of strip 310 may be pulled from between signal generator 150 and battery 160. Strap 170 remains in case 120 after launch.

Pulling strip 170 from between signal generator 150 and battery 160 enables battery 160 to contact signal generator 150 thereby providing energy to signal generator 150 for providing a stimulus signal. Removal of front portion 1340 energizes electrified projectile 130 at launch.

In one implementation, tab 170 includes a five-layer flexible circuit. Layers 1401, 1402, 1403, 1404, and 1405 are an insulator, a conductor, an insulator, a conductor, and an insulator respectively. Opening 1330 exposes terminal E3 on layer 1402. Opening 1421 and 1422 expose terminals E1 and E2 respectively on layer 1404. Void 1410 interrupts layer 1404 such that terminals E1 and E2 are not electrically connected in strap 170. Feed through 1320 (terminals E4 and E5) couples layer 1402 and a portion of layer 1404 that lies between feed through 1320 and void 1410. Feed through 1320 does not connect layer 1402 to the portion of layer 1404 that lies between void 1410 and the end portion of strip 310.

Placing a conductor between terminals E3 and E2 or between terminals E1 and E2 couples layer 1402 to the portion of layer 1404 that lies between void 1410 and the end portion of strip 310. The portion of strip 310 indicated as battery portion 1430 contacts battery 160 prior to launch. The portion of strip 310 indicated as signal generator portion 1432 contacts signal generator 150 prior to launch. Thus, prior to launch battery 160 connects to layer 1404 and signal generator 150 connects to layer 1402, but void 1410 acts as an open switch between battery 160 and signal generator 150. The switch may be closed such that battery 160 may be coupled to signal generator 150 by electrically connecting terminals E3 and E2 or terminals E1 and E2 as stated above.

In practice, terminals E2 and E3 may be coupled to energized signal generator 150 during assembly. Terminals E1 and E2 may be coupled to energize signal generator 150 after inserting electrified projectile 130 into case 120.

A wad further includes a web. A web may provide adjustability in the flexibility of grips. For example, web 1610 couples grips 230 and 240; and web 1612 couples grips 234 and 236. A web may be omitted to decrease an amount of force required to flex grips 230 through 240 to release electrified projectile 130.

The foregoing description discusses preferred embodiments of the present invention which may be changed or modified without departing from the scope of the present invention as defined in the claims. While for the sake of clarity of description, several specific embodiments of the invention have been described, the scope of the invention may be intended to be measured by the claims as set forth below.

What may be claimed is:

1. A round for inhibiting locomotion by a human or animal target, the round comprising:

a projectile having circuitry for delivering a current;

a case mechanically coupled to a rear portion of the projectile to hold the projectile in the case prior to launching of the projectile from the case, the projectile, after launching, for conducting the current through the target to cause contractions of skeletal muscles of the target to inhibit locomotion by the target; and a strap for enabling the circuitry to provide the current, wherein the strap is retained in the case.

2. A round for inhibiting locomotion by a human or animal target, the round comprising:

a projectile having circuitry for delivering a current;

a case mechanically coupled to a rear portion of the projectile to hold the projectile in the case prior to launching of the projectile from the case, the projectile, after launching, for conducting the current through the target to cause contractions of skeletal muscles of the target to inhibit locomotion by the target; and an anchor that couples the case to the rear portion of the projectile to hold the projectile in the case; wherein:

the case comprises a shoulder; and the anchor abuts the shoulder to hold the projectile in the case.

3. A round for inhibiting locomotion by a human or animal target, the round comprising:

a projectile having circuitry for delivering a current;

a case mechanically coupled to a rear portion of the projectile to hold the projectile in the case prior to launching of the projectile from the case, the projectile, after launching, for conducting the current through the target to cause contractions of skeletal muscles of the target to inhibit locomotion by the target; and an anchor that couples the case to the rear portion of the projectile to hold the projectile in the case; wherein:

the anchor comprises a prong; and the prong interferes with the projectile to hold the projectile in the case.

4. A round for inhibiting locomotion by a human or animal target, the round comprising:

a projectile having circuitry for delivering a current;

a case mechanically coupled to a rear portion of the projectile to hold the projectile in the case prior to launching of the projectile from the case, the projectile, after launching, for conducting the current through the target to cause contractions of skeletal muscles of the target to inhibit locomotion by the target; and an anchor; wherein:

the case has an inner diameter that decreases from a front of the case to a rear of the case; and the anchor interferes with the rear of the case to hold the projectile in the case.

5. A round for inhibiting locomotion by a human or animal target, the round comprising:

a projectile having circuitry for delivering a current;

a case mechanically coupled to a rear portion of the projectile to hold the projectile in the case prior to launching of the projectile from the case, the projectile, after launching, for conducting the current through the target to cause contractions of skeletal muscles of the target to inhibit locomotion by the target;

a strap for enabling the circuitry to provide the current; and an anchor having a tab; wherein:

a portion of the strap is positioned between the tab and the case.

6. The round of claim 2 further comprising a primer mechanically coupled to the case, whereby the round becomes live.

7. A method for assembling a round, the method comprising:

inserting an electrified projectile into a front opening of a case of the round until the projectile abuts a shoulder of the case;

inserting an anchor into a rear opening of the case until the anchor abuts the shoulder;

joining the anchor and the projectile to hold the projectile in the case; and attaching a base to a rear portion of the case.

8. The method of claim 7 further comprising inserting a primer into the base, whereby the round becomes live.

9. The method of claim 8 wherein inserting the primer occurs before attaching the base.

10. The method of claim 7 wherein inserting the anchor occurs before inserting the projectile.

11. The method of claim 7 wherein:

inserting the anchor further comprises aligning a strap of the projectile to the anchor; and the anchor retains the strap.

12. A method for assembling a round, the method comprising:

coupling an anchor to a rear portion of an electrified projectile;

inserting the projectile into a front opening of a case of the round; wherein the anchor interferes with the case to hold the projectile in the case.

13. The method of claim 12 wherein the method further comprises inserting a primer into the round, whereby the round becomes live.

14. The method of claim 13 wherein inserting the primer is performed before inserting the projectile.

15. A method for releasing a projectile from a round, the round comprising the projectile and a case, the method comprising:

urging a grip of the projectile away from an anchor of the case, wherein prior to urging the anchor interferes with the grip to hold the projectile in the case;

while the grip is away from the anchor, propelling the projectile away from the case; and after the anchor no longer interferes with the grip, enabling a circuit of the projectile to provide a current through a human or animal target.

16. The method of claim 15 wherein urging is accomplished by an expanding gas and propelling is accomplished by the expanding gas.

17. The method of claim 16 wherein the round further comprises a pyrotechnic material for producing the expanding gas.

18. A round for inhibiting locomotion by a human or animal target, the round comprising:

a projectile having circuitry for delivering a current;

a case; and a prong; wherein:

the prong mechanically couples to the case and interferes with a rear portion of the projectile to hold the projectile in the case prior to launching of the projectile from the case; and after launch, the projectile delivers the current through the target to cause contractions of skeletal muscles of the target to inhibit locomotion by the target.

19. The round of claim 18 further comprising a grip, wherein:

the grip mechanically couples to the rear portion of the projectile; and the prong interferes with the grip to hold the projectile.

20. The round of claim 18 further comprising a strap for enabling the circuitry to provide the current, wherein the strap is retained in the case.

21. The round of claim 18 further comprising an anchor that mechanically couples to the case, wherein the anchor comprises the prong.

22. The round of claim 21 wherein:

the case comprises a shoulder; and the anchor abuts the shoulder to hold the projectile in the case.

23. A round for inhibiting locomotion by a human or animal target, the round comprising:

a projectile having circuitry for delivering a current;

a prong; and a case; wherein:

the case mechanically couples to a rear portion of the projectile to hold the projectile in the case prior to launching of the projectile from the case;

prior to launch, the projectile is recessed within the case;

after launch, the projectile delivers the current through the target to cause contractions of skeletal muscles of the target to inhibit locomotion by the target; and the prong:

mechanically couples to the case; and interferes with a rear portion of the projectile to hold the projectile in the case prior to launching of the projectile from the case.

24. A round for inhibiting locomotion by a human or animal target, the round comprising:

a projectile having circuitry for delivering a current;

a case:

a grip; and a prong; wherein:

the grip mechanically couples to the rear portion of the projectile;

the prong mechanically couples to the case;

the prong interferes with the grip to hold the projectile in the case prior to launching of the projectile from the case;

prior to launch, the projectile is recessed within the case; and after launch, the projectile delivers the current through the target to cause contractions of skeletal muscles of the target to inhibit locomotion by the target;

* * * * *